United States Patent [19]

Ueguri

[11] Patent Number: 4,662,737

[45] Date of Patent: May 5, 1987

[54] DEVELOPING COLOR DISPLAY DEVICE OF COPYING MACHINE

[75] Inventor: Tomoaki Ueguri, Nara, Japan

[73] Assignee: Sharp Kabushiki Kaisha, Osaka, Japan

[21] Appl. No.: 808,089

[22] Filed: Dec. 12, 1985

[30] Foreign Application Priority Data

Dec. 12, 1984 [JP] Japan ..... 59-263912

[51] Int. Cl.[4] ..... G03G 15/01

[52] U.S. Cl. ..... 355/4; 355/35

[58] Field of Search ..... 355/4, 32, 35, 14 R, 355/14 D, 27

[56] References Cited

U.S. PATENT DOCUMENTS 3,438,709 4/1969 Hatashita ..... 355/35

3,825,337 7/1974 Lucas ..... 355/4

*Primary Examiner*—Richard A. Wintercorn

*Attorney, Agent, or Firm*—Birch, Stewart, Kolasch & Birch

[57] ABSTRACT

A developing color display device of a copying machine including a control circuit for outputting a signal corresponding to the developing color in a development cell, light emitting bodies of three primary colors (red, blue and green) that are selectively turned ON and/or whose luminous intensities are changed according to the signal output from the control circuit, and a developing color indicator for presenting a desired developing color synthesized by lights from the three primary color light emitting bodies.

2 Claims, 10 Drawing Figures

Fig. 8

| COLOR NO. | COLOR | CONNECTOR | | | |
|---|---|---|---|---|---|
| | | 1 | 2 | 3 | 4 |
| 1 | BLUE | ON | OFF | OFF | OFF |
| 2 | RED | OFF | ON | OFF | OFF |
| 3 | PURPLE | OFF | OFF | ON | OFF |
| 4 | GREEN | OFF | OFF | OFF | ON |
| 5 | LIGHT BLUE | ON | ON | OFF | OFF |
| 6 | YELLOW | ON | OFF | ON | OFF |
| ⋮ | ⋮ | ⋮ | ⋮ | ⋮ | ⋮ |
| 16 | NO COLOR | OFF | OFF | OFF | OFF |

FIG. 9

| COLOR NO. | COLOR | Amp | | |
|---|---|---|---|---|
| | | ERi | EGi | EBi |
| 1 | BLUE | 10V | 10V | 0V |
| 2 | RED | 0V | 10V | 10V |
| 3 | PURPLE | 0V | 10V | 0V |
| 4 | GREEN | 10V | 0V | 10V |
| 5 | LIGHT BLUE | 10V | 0V | 0V |
| 6 | YELLOW | 0V | 0V | 10V |
| 7 | PINK | 0V | 5V | 5V |
| ⋮ | ⋮ | ⋮ | ⋮ | ⋮ |
| 16 | NO COLOR | 10V | 10V | 10V |

Fig. 10

| COLOR NO. | COLOR | Amp | | |
|---|---|---|---|---|
| | | ERO | EGO | EBO |
| 1 | BLUE | 10V | 10V | 0V |
| 2 | RED | 0V | 10 | 10V |
| 3 | PURPLE | 0V | 10V | 0V |
| 4 | GREEN | 10V | 0V | 10V |
| 5 | LIGHT BLUE | 10V | 0V | 0V |
| 6 | YELLOW | 0V | 0V | 10 V |
| 7 | PINK | 0V | 5V | 5V |
| ⋮ | ⋮ | ⋮ | ⋮ | ⋮ |
| 16 | NO COLOR | 10V | 10V | 10V |

DEVELOPING COLOR DISPLAY DEVICE OF COPYING MACHINE

BACKGROUND OF THE INVENTION

The present invention relates to a device for displaying a desired developing color of a copying machine capable of changing the developing color. More specifically, this invention relates to a developing color display device in which a control circuit outputs a signal corresponding to the developing color in a development cell in the copying machine to selectively turn on light emitting bodies of three primary colors (red, green and blue) and/or change the luminous intensities of the light emitting bodies according to the signal, so that a desired developing color of light is synthesized and presented on a developing color indicator.

FIG. 7 is a schematical plan view of a copying machine incorporating the conventional developing color display device. The copying machine 1 with an original cover 2 has a print switch 3, key switch 4, multi indicator 5 and developing color indicator 6. The developing color indicator 6 is composed of three display windows for blue, red and black. When additional developing colors are to be used, display windows may be added by the same number as the additional colors. Each display window is provided with a light emitting body such as an LED that emits a specific color of light so that, when a development cell of a particular color is loaded in the copying machine, only the light emitting body of this particular color is turned ON with the rest of the colors remaining OFF.

As described above, the conventional developing color display device is required to indicate developing colors independently and therefore involves an increased number of parts. There is no problem when the copying machine uses two or three developing colors. With 8 to 16 developing colors, however, the cost rises and at the same time the display space requirement increases accordingly, which is not desirable when producing a compact copying machine.

SUMMARY OF THE INVENTION

The object of the present invention is to provide a developing color display device of a copying machine which device uses light emitting bodies of three primary colors based on the theory of using three primary color lights, to reduce the display space requirement as well as increase the number of developing colors to be displayed.

Other objects and further scope of applicability of the present invention will become apparent from the detailed description given hereinafter. It should be understood, however, that the detailed description and specific examples, while indicating preferred embodiments of the invention, are given by way of illustration only. Various changes and modifications within the spirit and scope of the invention will become apparent to those skilled in the art from this detailed description.

The developing color display device of the present invention comprises a control circuit for outputting a signal corresponding to the developing color in a development cell, light emitting bodies of three primary colors (red, blue and green) that are selectively turned ON and/or whose luminous intensities are changed according to the signal output from the control circuit, and a developing color indicator for presenting a desired developing color synthesized by lights from the three primary color light emitting bodies.

BRIEF DESCRIPTION OF THE DRAWINGS

The present invention will become more fully understood from the detailed description given hereinbelow and the accompanying drawings which are given by way of illustration only, and thus are not limitative of the present invention and where:

FIG. 8 shows developing colors and corresponding ON/OFF states of the contacts;

FIG. 9 shows developing colors and corresponding AMP input voltages; and

FIG. 10 shows developing colors and corresponding AMP output voltages.

DESCRIPTION OF THE INVENTION

Figure 1:
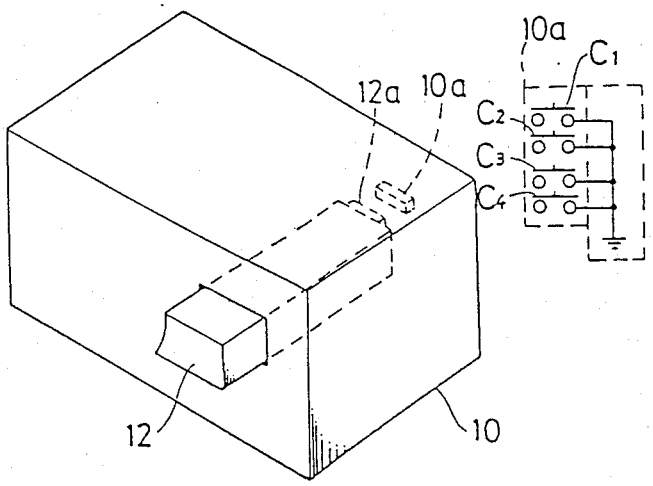
FIG. 1 is a perspective view schematically showing an embodiment of the copying machine of the present invention.

FIG. 1 is a perspective view schematically showing an embodiment of the copying machine of the present invention.

Referring to the figure, 10 is a copying machine. When a development cell 12 is loaded in the copying machine 10, a development cell connector 12*a* is made to contact with a copying machine connector 10*a*. The development cell 12 is replaceable for each intended developing color for copying. As shown in FIG. 8, the four contacts C1, C2, C3 and C4 between the connectors 10*a* and 12*a* are selectively turned ON in various combinations depending upon the developing color of the development cell 12 loaded in the copying machine 10. For blue copying, for instance, the contact C1 is turned ON. For light blue copying, the contacts C1 and C2 are turned ON with the rest OFF. Since there are four contacts, up to sixteen kinds of color are detectable. For a wider variety of developing colors, the number of contacts may be increased correspondingly.

Figure 2:
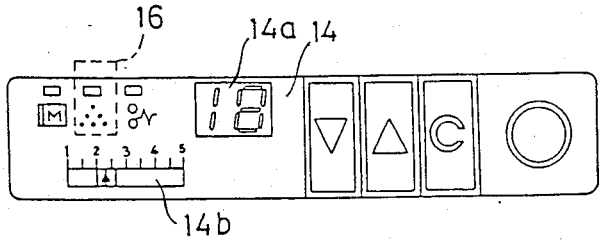
FIG. 2 is a plan view showing an operation panel on top of the copying machine of the present invention.

FIG. 2 shows the operation panel 14 on top of a copying machine 10. The operation panel 14 contains a copy number indicator 14*a*, density setting gauge 14*b* and developing color indicator 16.

Figure 3:
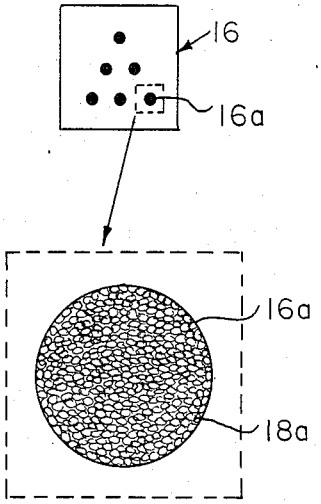
FIG. 3 is an enlarged view of a developing color indicator.
Figure 4:
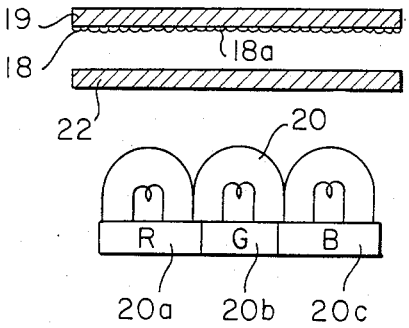
FIG. 4 is a schematical sectional view of the developing color indicator.

FIG. 3 shows the developing color indicator 16 in an enlarged view and one of the seven round indication elements 16*a* in a further enlarged view. As shown in FIG. 4 in sectional view, the round indication element 16*a* comprises a lens filter 18 having numerous small lenses 18*a* and an irregular reflection filter 19 laid over the lens filter 18.

The three primary color light emitting body 20 is composed of a red light emitting body 20*a*, green light emitting body 20*b* and blue light emitting body 20*c*. Light emitting diodes or lamps may be used as light emitting elements. This embodiment uses lamps. R, G and B in the figure represent red, green and blue, respectively. As described later, one or a plurality of these light emitting bodies 20*a*, 20*b* and 20*c* are selectively turned ON. Accordingly, one of the three primary color lights or two or all of the three primary color lights are passed through an intermediate irregular reflection filter 22 to synthesize a desired developing color light. The synthesized color light is then finely condensed by the numerous small lenses 18*a* of the lens filter 18 before being synthesized again by the irregular reflection filter 18 to be presented on the developing color indicator 16.

Figure 5:
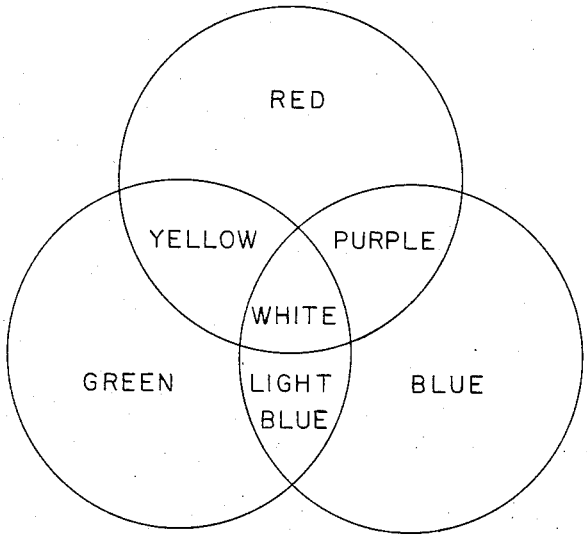
FIG. 5 is a color synthesizing chart of three primary color lights.

FIG. 5 is a color synthesizing chart of three primary color lights. According to the chart, the mixture of red and blue lights turns purple, and the mixture of green and blue lights turns light blue. The mixture of all the three primary color lights turns white. The chart shows a total of seven colors including the primary colors. In addition to these seven colors, neutral tints can be synthesized by varying the luminous intensity of each light emitting body 20*a*, 20*b* or 20*c*. To be specific, 16 colors can be synthesized, as shown in FIGS. 8, 9 and 10, by varying the light emission voltages. It is possible to synthesize further additional colors if required, through the voltage variation. In FIGS. 8, 9 and 10, "there is not a color" indicates that no development cell 12 loaded in the copying machine 10.

Figure 6:
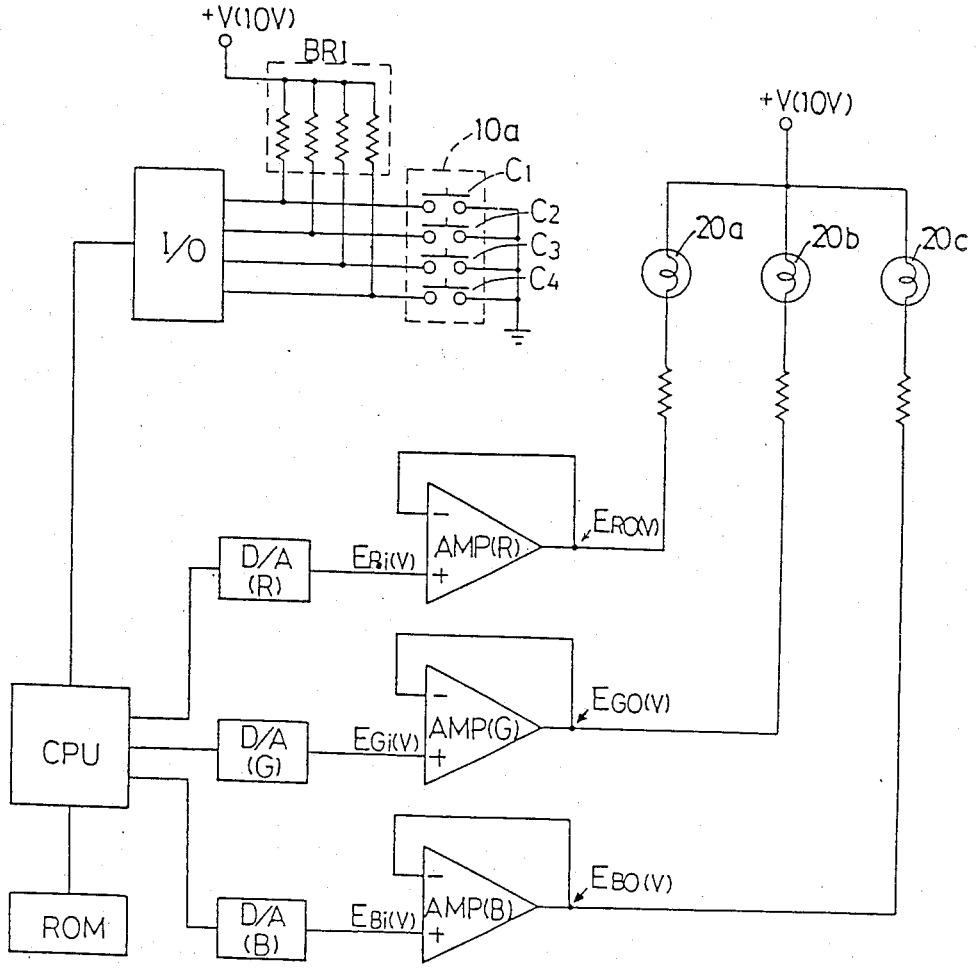
FIG. 6 is a circuit diagram of the control circuit of the present invention.
Figure 7:
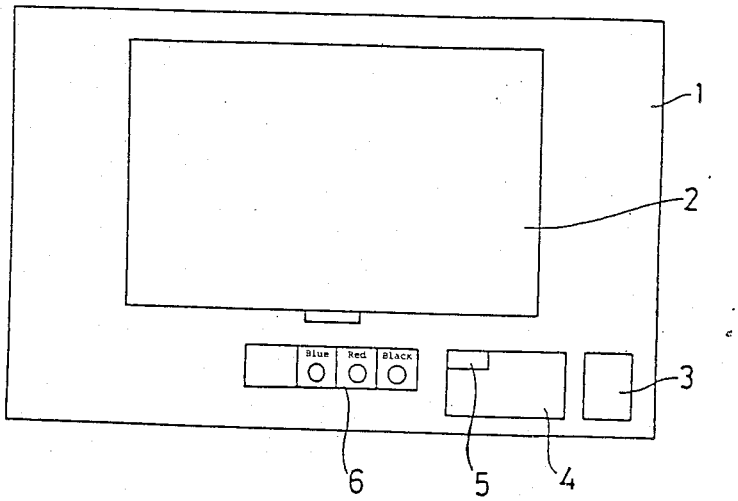
FIG. 7 shows the construction of a copying machine having a conventional developing color display device.

FIG. 6 shows a control circuit of the developing color display device. When the copying machine connector 10*a* is turned ON/OFF by the development cell 12 loaded in the copying machine, a developing color identification signal is transmitted by a group of pull-up resistors to a central processing unit (CPU) via a port I/O. The CPU reads AMP input voltage values corresponding to the developing color from a read-only-memory (ROM) as shown in FIG. 9 and sends the digital signals to the appropriate D/A converters for conversion to analog signals. The analog voltage signals $ER_i$, $EG_i$ and $EB_i$ are transmitted through limiter circuits AMP (R), AMP (G), AMP (B) and output as AMP output voltages $ER_o$, $EG_o$ and $EB_o$ as shown in FIG. 10. The luminous intensities of red, green and blue light emitting bodies 20*a*, 20*b* and 20*c* vary depending upon the difference between a supply voltage V for each light emitting body and each AMP output voltage, thereby presenting various developing colors including neutral tints. The supply voltage V is set at 10 V in the present invention, though it may be otherwise set depending upon the circuit design.

As understood from the above description, the present invention realizes a compact developing color display device capable of presenting a variety of desired developing color lights.

While only certain embodiments of the present invention have been described, it will be apparent to those skilled in the art that various changes and modifications may be made therein without departing from the spirit and scope of the present invention as claimed.

What is claimed is:

1. A developing color display device of a copying machine, comprising: a control circuit for outputting a signal corresponding to the developing color in a development cell; light emitting bodies of three primary colors (red, blue and green) that are selectively turned ON and/or whose luminous intensities are changed according to the signal output from said control circuit; and a developing color indicator for presenting a desired developing color synthesized by lights from said three primary color light emitting bodies.

2. The developing color display device of the copying machine as claimed in claim 1 in which said developing color indicator contains an irregular reflection filter using a lens.

* * * * *